US010914046B1

(12) United States Patent
Nasir et al.

(10) Patent No.: US 10,914,046 B1
(45) Date of Patent: Feb. 9, 2021

(54) SYSTEM, APPARATUS, AND METHOD FOR INSTALLING A FOUNDATION

(71) Applicants: Jamal Nasir, Doha (QA); Haidar Jamal, Pittsburgh, PA (US)

(72) Inventors: Jamal Nasir, Doha (QA); Haidar Jamal, Pittsburgh, PA (US)

( * ) Notice: Subject to any disclaimer, the term of this patent is extended or adjusted under 35 U.S.C. 154(b) by 0 days.

(21) Appl. No.: 16/990,675

(22) Filed: Aug. 11, 2020

(51) Int. Cl.
*E02D 5/46* (2006.01)
*E02D 5/36* (2006.01)
*E21B 44/02* (2006.01)

(52) U.S. Cl.
CPC ..... *E02D 5/46* (2013.01); *E02D 5/36* (2013.01); *E21B 44/02* (2013.01); *E02D 2250/0038* (2013.01); *E02D 2600/10* (2013.01)

(58) Field of Classification Search
CPC .... E02D 7/02; E02D 7/06; E02D 7/22; E02D 5/36; E02D 5/46; E02D 2600/10
See application file for complete search history.

(56) References Cited

U.S. PATENT DOCUMENTS 4,504,173 A * 3/1985 Feklin ..... E02D 5/36 405/240
5,542,786 A 8/1996 Blum
5,722,498 A * 3/1998 Van Impe ..... E02D 5/36 175/394
6,033,152 A * 3/2000 Blum ..... E02D 5/36 175/325.3
7,198,434 B2 * 4/2007 Blum ..... E02D 5/36 175/323
8,322,458 B2 * 12/2012 Stoetzer ..... E21B 7/005 173/145
8,511,941 B2 * 8/2013 Curic ..... E02D 5/36 405/271
8,821,072 B2 * 9/2014 Ditillo ..... E02D 7/22 405/232
10,053,980 B2 8/2018 Godager
2014/0352449 A1 * 12/2014 Hale ..... E02D 33/00 73/786
2018/0245304 A1 * 8/2018 Koller ..... B66C 23/90
2018/0266245 A1 9/2018 Gillan
2020/0149241 A1 * 5/2020 Flanigan ..... E02D 7/24

FOREIGN PATENT DOCUMENTS

CN 106120717 A 11/2016
DE 100 06 973 C2 3/2002
FR 3051205 * 11/2017
KR 10-1257271 4/2013

* cited by examiner

*Primary Examiner* — Frederick L Lagman
(74) *Attorney, Agent, or Firm* — Stephen L. Keefe LLC

(57) ABSTRACT

A method for installing a pile in a cavity of a soil layer is disclosed. The method includes drilling the cavity in the soil layer using a drilling assembly, applying pressure with the drilling assembly during drilling to an interface portion of the soil layer that is adjacent to the cavity, sensing pressure data of the interface portion during drilling, and transferring the pressure data to a controller during drilling. The method also includes determining pile capacity data of the pile with the controller during drilling based on the pressure data, transferring the pile capacity data during drilling, and controlling the drilling assembly based on the pile capacity data during drilling.

17 Claims, 9 Drawing Sheets

SYSTEM, APPARATUS, AND METHOD FOR INSTALLING A FOUNDATION

TECHNICAL FIELD

The present disclosure generally relates to an installation system, apparatus, and method, and more particularly to a system, apparatus, and method for installing a foundation.

BACKGROUND

Drilled displacement piles (DDPs) have emerged as a deep foundation solution for carrying loads in soft-to-medium dense soils. Installation of this type of pile is typically performed by utilizing a heavy-duty piling rig to apply both rotary action and pull-down on a drill rod having a DDP tool attached to its lower end. During installation, the surrounding soil is displaced and compacted by the DDP tool. This process usually causes significant radial stresses to become locked into the soil in the vicinity of the pile shaft, which results in a relatively higher load-carrying capacity of these piles compared to bored piles.

The radial stresses that develop at the pile-soil interface during installation of a DDP contribute to the ultimate frictional capacity of that pile. Additionally, due to the complex machine-soil interaction that takes place during installation, the actual magnitude of the radial stresses that are locked into this interface and adjoining soil often vary significantly from one pile to another. The radial stresses may vary even if the soil conditions or the pile diameter remain unchanged between adjacent piles.

Evaluations of load carrying capacity of DDPs are typically performed using empirical methods based on data gathered from pile load tests and/or soil investigation undertaken prior to start of pile installation works, with little or no consideration of the magnitude of radial stresses that may actually exist at the soil interface of any given pile. When the variable nature of soil even between two adjacent locations in proximity to each other is also considered, the in-situ frictional capacities of the piles that are installed at a site may differ significantly from the capacities calculated using the current state of conventional practice. These existing conventional techniques often lead either to unnecessary costs arising from installed piles having significantly more load-carrying capacity than needed or, on the other hand, to installation of piles that lack an adequate factor of safety against applied loads.

For example, U.S. Pat. No. 10,053,980 to Godager (the '980 patent) discloses a soil stress measuring system for checking the stability of boreholes. The '980 patent discloses a pressure sensor that is arranged outside of a wellbore conduit. See the '980 patent at col. 2 at lines 47-54. However, the '980 patent, as best understood, does not determine a load-carrying capacity of a pile during a drilling operation. The '980 patent apparently has no application for a drilled displacement pile because for a drilled displacment pile, as soon as the cavity has been drilled to the desired depth, concrete is injected into the cavity as the tool is lifted.

The exemplary disclosed system, apparatus, and method are directed to overcoming one or more of the shortcomings set forth above and/or other deficiencies in existing technology.

SUMMARY OF THE DISCLOSURE

In one exemplary aspect, the present disclosure is directed to a method for installing a pile in a cavity of a soil layer. The method includes drilling the cavity in the soil layer using a drilling assembly, applying pressure with the drilling assembly during drilling to an interface portion of the soil layer that is adjacent to the cavity, sensing pressure data of the interface portion during drilling, and transferring the pressure data to a controller during drilling. The method also includes determining pile capacity data of the pile with the controller during drilling based on the pressure data, transferring the pile capacity data during drilling, and controlling the drilling assembly based on the pile capacity data during drilling.

In another aspect, the present disclosure is directed to an apparatus for installing a pile in a cavity of a soil layer. The apparatus includes a drilling assembly configured to be supported and driven by a drilling rig, at least one pressure sensor disposed on the drilling assembly, the at least one pressure sensor configured to sense pressure data that is indicative of an actual lateral stress of the soil layer adjacent to the cavity, and a communication device disposed on the drilling rig. The apparatus also includes a wire connector connecting the communication device and the at least one pressure sensor, a user interface used by an operator of the drilling rig and wirelessly connected to the communication device, and a controller that is wirelessly connected to the communication device. The controller is configured to receive the pressure data during drilling. The controller is configured to determine pile capacity data of the pile during drilling based on the pressure data. The controller is configured to transfer the pile capacity data to the user interface.

DETAILED DESCRIPTION AND INDUSTRIAL APPLICABILITY

The exemplary disclosed system, apparatus, and method may provide for installing a foundation such as a deep foundation. The exemplary disclosed system, apparatus, and method may provide for installing a pile. In at least some exemplary embodiments, the exemplary disclosed system, apparatus, and method may include a tool for evaluation of frictional capacity of a pile while installation of the pile is taking place. For example, the exemplary disclosed system, apparatus, and method may include a system (e.g., a tool) for evaluation of frictional capacity of a drilled displacement pile (DDP) while installation of the DDP is taking place.

Figure 1:
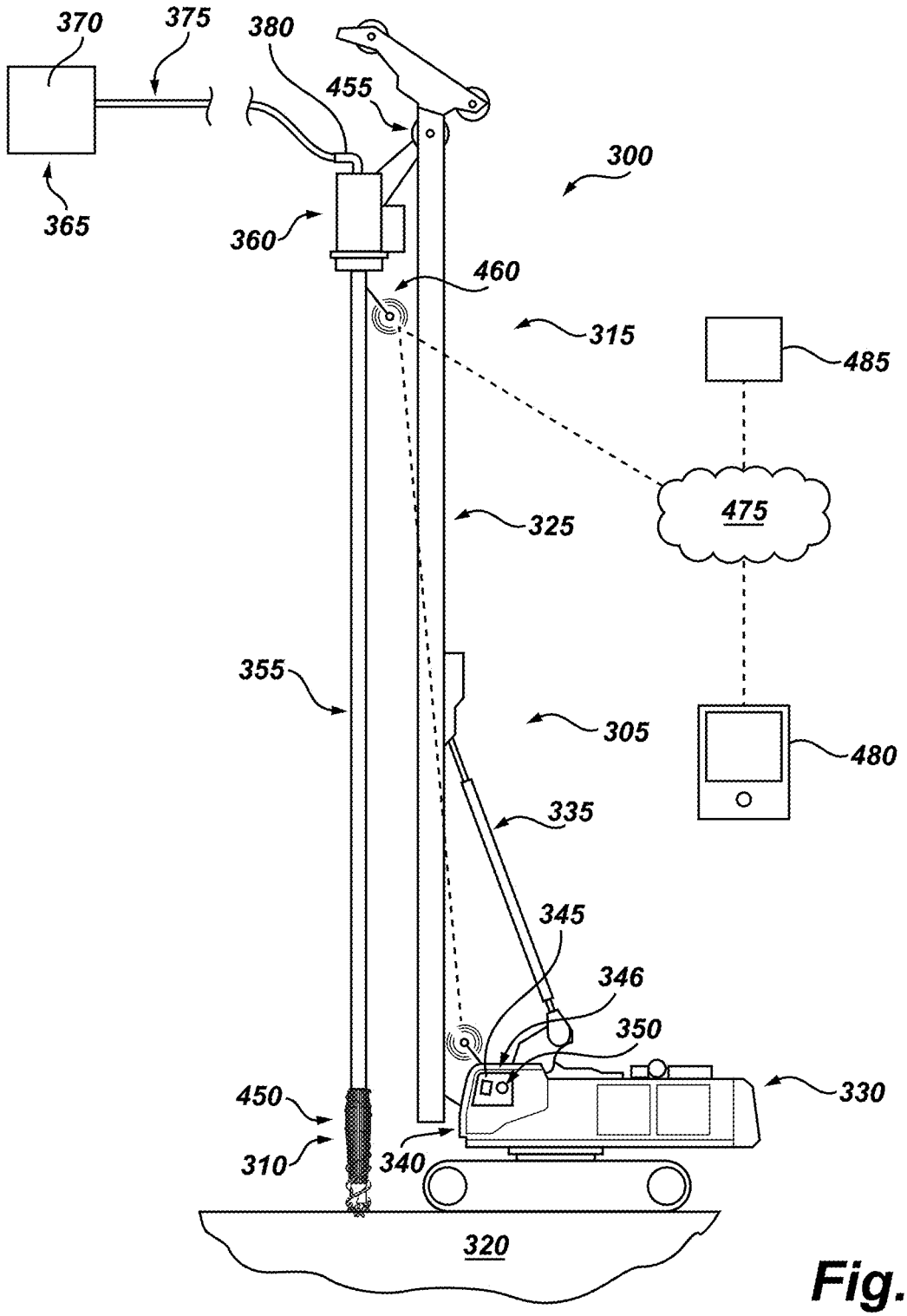
FIG. 1 illustrates a schematic view of at least some exemplary embodiments of the present disclosure.

In at least some exemplary embodiments and as illustrated in FIG. 1, the exemplary disclosed system, apparatus, and method may include a system 300. System 300 may include a drilling rig or drilling system 305, a drilling assembly 310, and a control system 315. Drilling assembly 310 may be attached to drilling system 305 and may drill into a soil layer 320 (e.g., a surface layer that may include the ground or earth formed from for example soil or other material). Control system 315 may be attached to drilling assembly 310 and may sense data associated with soil layer 320.

Drilling rig or drilling system 305 may be any suitable system for installing a foundation for example as described herein. Drilling system 305 may be a piling rig such as a heavy duty piling rig. For example, drilling system 305 may be a fixed-mast, rotary drill rig. Drilling system 305 may be an auger displacement pile rig. Drilling system 305 may maintain any desired pull down and torque on drilling assembly 310 during drilling. Drilling system 305 may be used to install drilled displacement piles such as screw piles. Drilling system 305 may be used to install any suitable type of pile such as a screw displacement pile, an SVB pile, an APGD pile, an SVV pile, an Atlas pile, a De Waal pile, an Omega pile, a Fundex pile, a Full Displacement Pile (FDP), a Continuous Flight Auger (CFA) pile, a Partial Displacement Pile (PDP), a Rigid Inclusion (RI), a Controlled Modulus Column (CMC), a Skanska cementation soil displacement pile, and/or an Olivier pile.

Drilling system 305 may include a boom 325 attached to and structurally supported by a drilling rig base 330. Boom 325 may be adjusted (e.g., moved or angled) relative to drilling rig base 330 by assembly 335 that may be any suitable movable assembly (e.g., a hydraulic, pneumatic, or mechanical assembly). Drilling rig base 330 may include an operator cabin 340 in which an operator 350 may be located during operation of system 300. A user interface 345 for example as described herein may be disposed in operator cabin 340 and/or integrated into any suitable components of system 300.

User interface 345 may be utilized by operator 350 to control system 300. User interface 345 may include a wireless receiver for receiving data from other components of system 300, a processor, and a monitor for displaying information to operator 350 (e.g., and/or some or substantially all of the exemplary disclosed controller described for example herein). User interface 345 may be a stand-alone device that may be part of drilling system 305 or control system 315 or may be integrated into one or more components of drilling system 305 and/or control system 315.

User interface 345 may include any suitable components for operator 350 to input or be provided with data and information. For example, user interface 345 may include a keypad, a touchscreen device, a keyboard (e.g., a computer keyboard), and/or an assembly including movable members (e.g., buttons, knobs, slidable or rotatable switches, dials, levers, and/or any other suitable mechanical or electromechanical components). User interface 345 may also include one or more biometric devices (e.g., a fingerprint device and/or facial recognition device). User interface 345 may also include an audio-based device for entering input and/or receiving output via sound, a tactile-based device for entering input and receiving output based on touch or feel, a dedicated user device or interface designed to work specifically with other components of system 300, and/or any other suitable user device or interface.

Drilling system 305 may include a drill rod assembly 355 that may be attached to boom 325 via a movable assembly 360. Movable assembly 360 may be movably attached to boom 325 and may move downward and upward along boom 325 as system 300 drills into soil layer 320. Movable assembly 360 may include any suitable components for moving and imparting forces to drill rod assembly 355 such as pull down and torque during drilling. Movable assembly 360 may move and rotate drill rod assembly 355 to provide a drilling operation of system 300 for example as described herein.

Movable assembly 360 may also be fluidly connected to a storage or reservoir 365 that holds a material 370. For example, a passage 375 may fluidly connect reservoir 365 to an inlet 380 of movable assembly 360. In at least some exemplary embodiments, material 370 may be cementitious material such as concrete, slurry, or other material that may be maintained in a liquid form prior to curing. Material 370 may be in an uncured or liquid form when stored in reservoir 365. For example, reservoir 365 may be a drum of a concrete mixing truck, a concrete hopper, or any other suitable assembly for maintaining concrete in a liquid form prior to placement and curing. Reservoir 365 may be pressurized or unpressurized. Reservoir 365 and/or movable assembly 360 may include any suitable pump components to pressurize material 370 to cause or help material 370 to flow through components of system 300 for example as described herein.

Movable assembly 360 may include hollow portions such as one or more cavities that may fluidly connect reservoir 370 via passage 375 and inlet 380 with hollow portions of drill rod assembly 355 for example as described herein. Material 370 may thereby be transferred from reservoir 365 to a location in soil layer 320 via fluidly-connected cavities of system 300.

Figure 2:
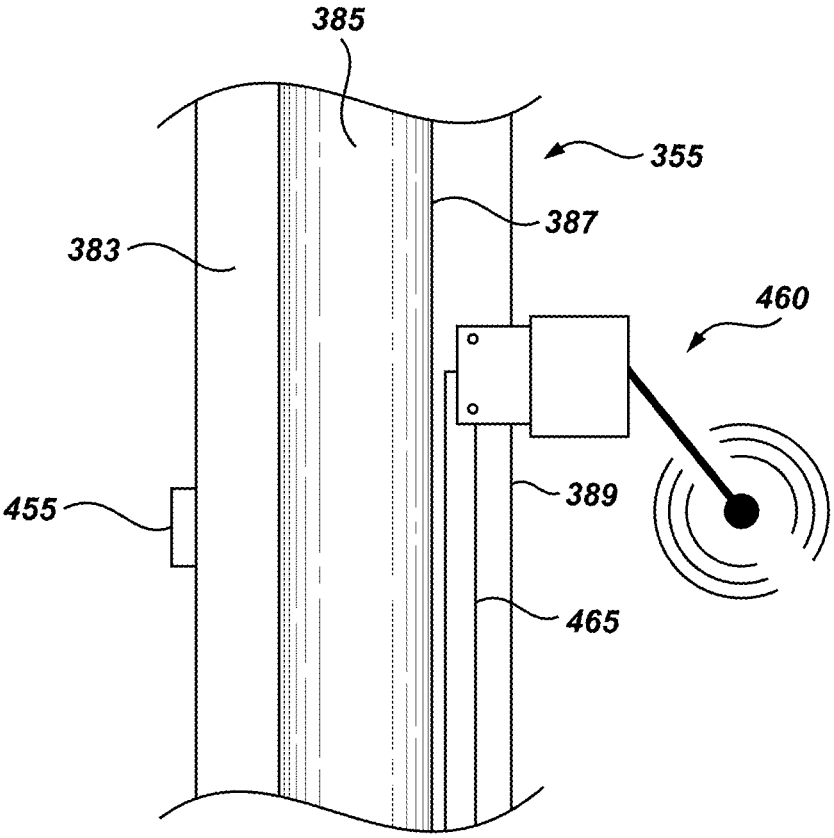
FIG. 2 illustrates a sectional view of at least some exemplary embodiments of the present disclosure.

Drill rod assembly 355 may be any suitable drill rod for being attached between movable assembly 360 and drilling assembly 310 and for driving drilling assembly 310 to drill through soil layer 320. As illustrated in FIG. 2, drill rod assembly 355 may include a cavity 385. Cavity 385 may be an elongated cavity that extends along a length (e.g., substantially entire length) of drill rod assembly 355. Material 370 may be transferred from movable assembly 360 to drilling assembly 310 via cavity 385. Drill rod assembly 355 may thereby contribute to delivering material 370 (e.g., contribute to transfer or pumping of uncured concrete) to a desired location of soil layer 320 during drilling and foundation installation for example as described herein.

In at least some exemplary embodiments and as illustrated in FIG. 2, cavity 385 may be formed by a member 387 that may be disposed in a member 389 of drill rod assembly 355. Member 387 may be any suitable structural member for forming cavity 385 for transferring material 370. For example, member 387 may be an elongated structural member such as a structural metal member, e.g., a steel or aluminum structural member. Member 387 may for example include a structural tube, structural pipe, one or more structural channels, and/or be a built-up member including a plurality of structural shapes. Member 389 may be size larger than member 387 and may be formed generally similarly to member 387. Member 387 may be disposed within member 389 so that a cavity 383 is formed between an outer surface of member 387 and an inner surface of member 389. For example, cavity 383 may extend around a partial or substantially entire perimeter or surface area (e.g., encircle) of an outer surface of member 387. In at least some exemplary embodiments, cavity 383 may extend along a substantially entire length of drill rod assembly 355. In at least some exemplary embodiments, cavity 383 may be a space formed between member 389 that may be an outer pipe and member 387 that may be an inner pipe.

Returning to FIG. 1, drilling assembly 310 may be removably attached to drill rod assembly 355. Drilling assembly 310 may be any suitable drilling assembly for providing the exemplary disclosed foundation installation (e.g., pile installation). For example, drilling assembly 310 may be a DDP tool. Drilling assembly 310 may provide for installation of any suitable pile type such as a screw displacement pile, an SVB pile, an APGD pile, an SVV pile, an Atlas pile, a De Waal pile, an Omega pile, a Fundex pile, a Full Displacement Pile (FDP), a Continuous Flight Auger (CFA) pile, a Partial Displacement Pile (PDP), a Rigid Inclusion (RI), a Controlled Modulus Column (CMC), a Skanska cementation soil displacement pile, and/or an Olivier pile.

Figures 3A, 3B:
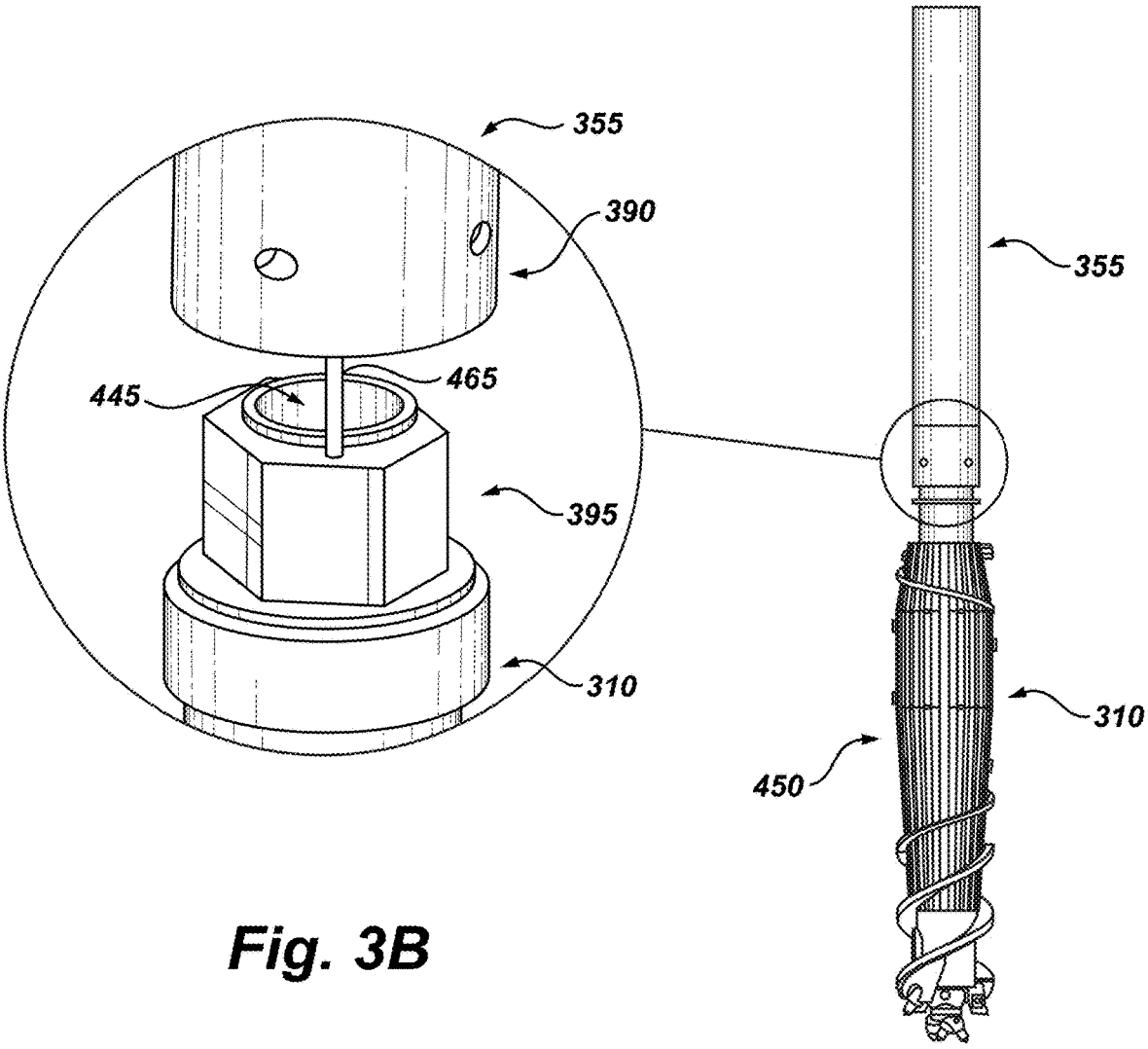
FIG. 3A illustrates a side view of at least some exemplary embodiments of the present disclosure.
FIG. 3B illustrates a perspective view of at least some exemplary embodiments of the present disclosure.

As illustrated in FIGS. 3A and 3B, drilling assembly 310 may be attached to an end portion 390 of drill rod assembly 355. Drilling assembly 310 may be attached to drill rod assembly 355 so that drill rod assembly 355 may rotatably drive one or more portions of drilling assembly 310 (e.g., to drill through soil layer 320). End portion 390 may include any suitable fasteners, protrusions, apertures, and other suitable engagement portions for removably attaching end portion 390 to an attachment portion 395 of drilling assembly 310. For example, end portion 390 and attachment portion 395 may be configured with corresponding recesses, apertures, protrusion, slots, grooves, threading, fasteners, and any other suitable elements (e.g., a corresponding shape and size) for removably attaching attachment portion 395 and end portion 390.

Figure 4:
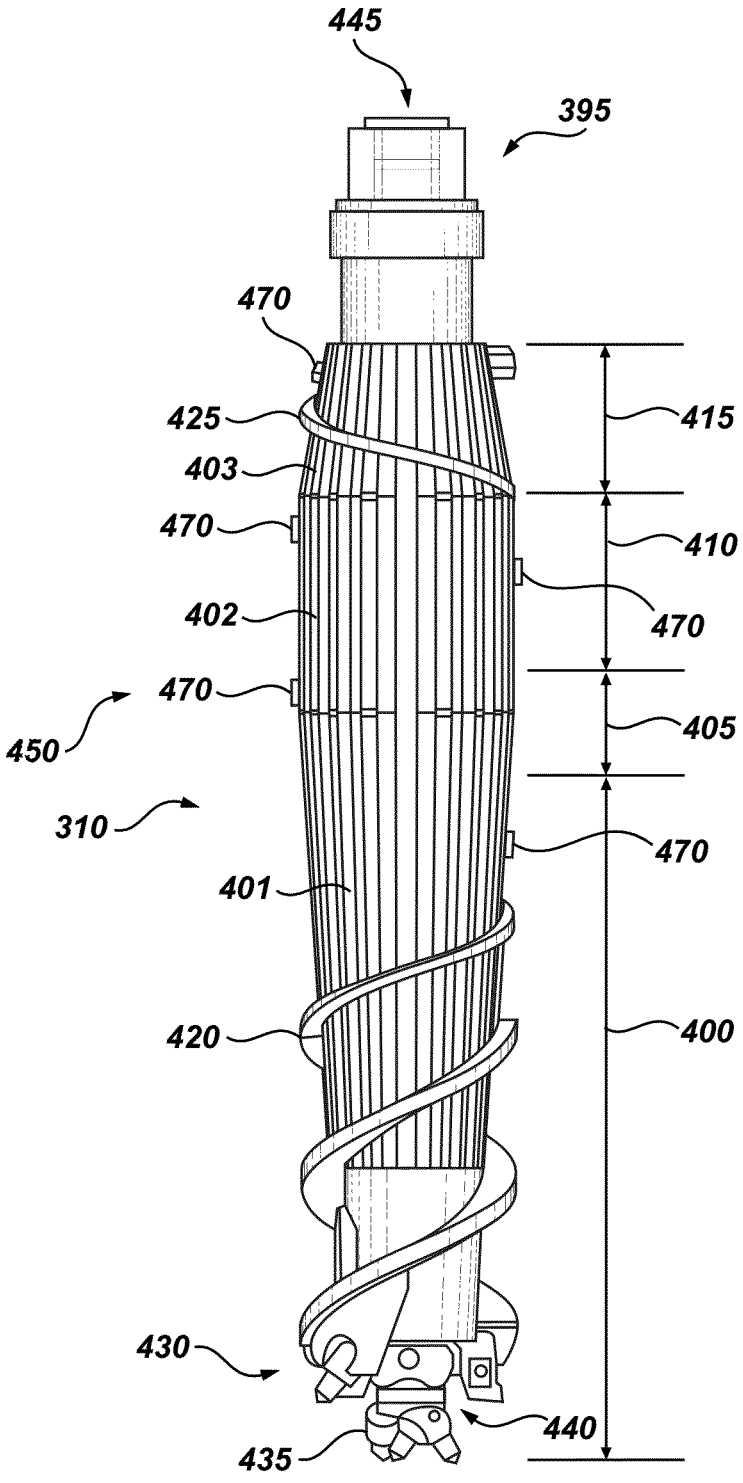
FIG. 4 illustrates a side view of at least some exemplary embodiments of the present disclosure.

As illustrated in FIG. 4, drilling assembly 310 may include a body portion 400, a body portion 405, a body portion 410, and a body portion 415. Drilling assembly 310 may also have any other desired number of body portions having any desired shapes. Drilling assembly 310 may also include one or more protrusions (e.g., protrusions 420 and 425) that extend (e.g., protrude) from one or more of body portion 400, body portion 405, body portion 410, and body portion 415. Protrusions 420 and 425 may be for example auger flights. Protrusions 420 and 425 may have any desired barrel diameter (e.g., from tip to tip of flights, distance between flights along length of drilling assembly 310), helix pitch, helix angle, and/or any other suitable measurements. For example, protrusion 420 may be an elongated auger flight that extends along body portion 400, and protrusion 425 may be an elongated auger flight that extends along body portion 415. Any suitable configuration of auger flights may be used. For example, drilling assembly 310 may include auger flights with all spirals in one (e.g., the same) direction (e.g., for a CFA pile). Also for example, drilling assembly 310 may have a continuous set of auger flights. Also for example, drilling assembly 310 may have any desired configuration of auger flights for installing any desired type of displacement pile.

Body portions 400, 405, 410, and 415 may rotate in either direction (e.g., clockwise or counterclockwise). For example as illustrated in FIG. 4, a body member 401 (e.g., including body portion 400 and part of body portion 405) and a body member 403 (e.g., including body portion 415) may be attached to a body member 402 (e.g., including a part of body portion 405 and body portion 410). Body members 401, 402, and 403 may be attached together (e.g., welded or fastened together) and may all be rotated together by drill rod assembly 355. For example, body members 401, 402, and 403 may be rigidly connected to each other. When drill rod assembly 355 operates to rotate drilling assembly clockwise, body members 401, 402, and 403 rotate clockwise. When drill rod assembly 355 operates to rotate drilling assembly counterclockwise (e.g., anti-clockwise), body members 401, 402, and 403 rotate counterclockwise. In at least some exemplary embodiments, drilling and extraction of drilling assembly 310 may be performed using clockwise rotation (e.g., which may cause the exemplary disclosed auger flights to interact with soil of soil layer 320).

Drilling assembly 310 may have any suitable or desired length, diameter, and shape. For example, drilling assembly 310 may have a diameter (e.g., nominal diameter) of up to a meter or more (e.g., between about 0.25 meter and about 1 meter), between about 400 mm (millimeters) and about 750 mm, or any other desired size. As illustrated in FIG. 4, body portion 400 may be of constant diameter or may increase in diameter in a direction moving from an end portion 430 to body portion 405 (e.g., an upward direction). Body portion 405 may increase in diameter and then maintain a substantially constant diameter in a direction (e.g., upward direction) moving toward body portion 410. Body portion 410 may have a substantially constant diameter along its length running between body portion 405 and body portion 415. Body portion 415 may decrease in diameter in a direction (e.g., upward direction) moving from body portion 410 to attachment portion 395.

Drilling assembly 310 may include one or more cavities 445 (e.g., as illustrated in FIG. 3B) that may be fluidly connected with cavity 385 when drill rod assembly 355 is connected to drilling assembly 310. As illustrated in FIG. 4, a member 435 such as a cutting member (e.g., drilling member) may be disposed at a bottom of end portion 430. Drilling assembly 310 may also include a movable member 440 that may be disposed at end portion 430. For example, movable member 440 may form a bottom portion of drilling assembly 310 (e.g., and may include member 435). Movable member 440 may be for example a trap door that opens when drilling assembly 310 is raised by drilling system 305 for example as described herein. Movable member 440 may selectively open to allow flow of material 370 out of cavity 445 for example as described herein.

Body portion 400 may be a lowest portion of drilling assembly 310. Body portion 400 may drill and/or push out soil of soil layer 320. During drilling operations for example as described herein, as drilling assembly 310 is rotated (e.g., in a clockwise direction or any other desired direction) via portions of drill rod assembly 355 being moved by movable assembly 360, a first portion of the soil of soil layer 320 is displaced outward during advancement of drilling assembly 310 through soil layer 320, and a second portion of the soil moves up protrusion 420 to body portion 405. The soil that moves to body portion 405 may be pushed out again by body portion 405 where protrusions 420 may end and body portion 410 begins. Body portion 410 may provide support to soil of soil layer 320 that has been displaced based on drilling of drilling assembly 310.

Returning to FIG. 1, control system 315 may include a sensor array 450, a sensor 455, a communication device 460, and a connector 465 (e.g., as illustrated in FIG. 2), and the exemplary disclosed controller (e.g., for example as described below). Connector 465 may transfer data from sensor array 450 to communication device 460. Communication device 460 may also receive data from sensor 455 (e.g., or sensor 455 may communicate directly with the controller).

As illustrated in FIG. 4, sensor array 450 may include one or more sensors 470. As illustrated in FIG. 4, one or more sensors 470 may be disposed at one or more locations of body member 402. Also for example, sensors 470 may be disposed on body members 401 and 403, drill rod assembly 355, and/or any other desired portions of system 300. Sensors 470 may communicate with other components of system 300 (e.g., with communication device 460) by wire communication, wireless communication, and/or any other suitable communication technique for example as described herein.

Sensor 470 may be any suitable sensor for sensing a pressure of soil of soil layer 320. For example, sensor 470 may make measurements associated with stresses that are locked into the surrounding soil (e.g., stresses of soil surrounding an installed pile shaft) of soil layer 320. For example, sensor 470 may be any suitable sensor for making measurements associated with (e.g., for determining) radial stresses that develop at a pile-soil interface during installation of a pile such as a drilled displacement pile. In at least some exemplary embodiments, sensor 470 may be any suitable sensor for making measurements associated with (e.g., for determining) lateral stress locked into the pile-soil interface of soil layer 320. Sensor 470 may be any suitable electromechanical sensor. Sensor 470 may include a strain gauge. Sensor 470 may be a linear displacement contact sensor such as a high-speed linear displacement contact sensor. For example, sensor 470 may be an LVDT sensor. Sensor 470 may be an optical fiber Bragg-Grating (FBG) sensor. Sensor 470 may be a piezoresistive sensor. For example, sensor 470 may be a micro silicon piezoresistive sensor. Sensor 470 may be a tactile pressure sensor. For example, sensor 470 may be a tactile pressure sheet sensor. Sensor 470 may be a fiber optic sensor. For example, sensor 470 may be a long-gauge fiber optic sensor. Sensor 470 may be an optoelectronic displacement sensor. Sensor 470 may be a null pressure sensor. Sensor 470 may be an elastic force distribution sensor. Sensor 470 may be a displacement sensor or a thin pressure sensor. For example, sensor 470 may be a flexible sheet pressure and deformation sensor (e.g., a thin sheet pressure sensor).

As illustrated in FIGS. 1 and 2, sensor 455 may be any suitable sensor for measuring a location of drilling assembly 310 in soil layer 320. Sensor 455 may measure a depth of drilling assembly 310 in soil layer 320. Sensor 455 may be a depth encoder. For example, sensor 455 may be a rotary encoder that may be attached to one or more rotatable components of drill rod assembly 355. For example, sensor 455 may be a rotary encoder that may be operably attached to a connector such as a pulley that measures rotation of the pulley to evaluate depth of components of drill rod assembly 355 as drilling assembly 310 is rotatably moved to drill through soil layer 320. Sensor 455 may include an inclinometer for sensing a verticality of drill rod assembly 355. Sensor 455 may include a location sensor such as a global positioning system sensor or other suitable location sensor. Sensor 455 may include fiber optic sensing components, accelerometer sensing components, and any other suitable components for sensing a depth, location, and/or position of components of drilling assembly 310, drill rod assembly 355, and/or other components of system 300 (e.g., drilling system 305). Sensor 455 may be disposed at any suitable position of system 300 such as, for example, at boom 325. For example, sensor 455 may be disposed at (e.g., attached to, on, in, or within) an upper portion of boom 325 (e.g., at a top portion of boom 325 such as a mast head as illustrated in FIGS. 1 and 2). In at least some exemplary embodiments, sensor 455 may be a depth encoder mounted at the top of boom 325 and that gives a value of the depth of drilling assembly 310 below ground level (e.g., below a top surface of soil layer 320) at substantially any desired point in time during operation of system 300 (e.g., based on a known or predetermined distance between sensor 455 and a bottom portion of drilling assembly 310).

Communication device 460 may include any suitable transceiver, receiver, and/or transmitter components for wirelessly communicating with other components of system 300 for example as described herein. Communication device 460 may also communicate by wire communication with other components of system 300. For example, communication device 460 may communicate with sensors 470 via connector 465. Communication device 460 may for example include components for communicating via wireless communication (e.g., CDMA, GSM, 3G, 4G, and/or 5G), direct communication (e.g., wire communication), Bluetooth communication coverage, Near Field Communication (e.g., NFC contactless communication such as NFC contactless methods), radio frequency communication (e.g., RF communication such as short-wavelength radio waves, e.g., UHF waves), and/or any other desired communication technique. Communication device 460 may be disposed at any suitable position of system 300 such as, for example, at drill rod assembly 355. For example, communication device 460 may be disposed at (e.g., attached to, on, in, or within) an upper portion of drill rod assembly 355 (e.g., at a top portion of drill rod assembly 355 as illustrated in FIGS. 1 and 2).

Connector 465 (e.g., or one or more connectors 465) may connect any desired components of system 300. For example as illustrated in FIG. 1, connector 465 may connect communication device 460 and sensor array 450 (e.g., one or more sensors 470). Connector 465 may be any suitable connector for providing wire communication between components of system 300. For example, connector 465 may be a wire, cable, cord, or any other suitable connector. Connector 465 may be for example a wire connector such as a copper cable, a twisted pair cable, a coaxial cable, a fiber cable such as a fiber optic cable, and/or any other suitable type of connector for providing direct or wire communication between components of system 300.

As illustrated in FIG. 2, connector 465 may be disposed in cavity 383 of drill rod assembly 355. For example, a portion of communication device 460 may extend through a wall of member 389 and may be attached to connector 465. One or more connectors 465 may extend through cavity 383 along a substantially entire length of drill rod assembly 355 from communication device 460 to drilling assembly 310. Connector 465 may then extend through one or more cavities of drilling assembly 310 and attach to some or all sensors 470 of sensor array 450. Some or all sensors 470 may thereby be connected by one or more connectors 465 to be in wire communication with communication device 460. Also for example, some or all sensors 470 may communicate wirelessly with communication device 460 (e.g., instead of, or in addition to, wire communication via one or more connectors 465).

As illustrated in FIG. 1, components of system 300 may wirelessly communicate directly and/or via a network component 475. Network component 475 may be a WAN such as, for example, described below regarding FIG. 9. Network component 475, a user device 480, a remote device 485, sensors 470, communication device 460, sensor 455, user interface 345, and/or any other suitable components of system 300 may communicate with each other via any suitable communication method such as, for example, wireless communication (e.g., CDMA, GSM, 3G, 4G, and/or 5G), direct communication (e.g., wire communication), Bluetooth communication coverage, Near Field Communication (e.g., NFC contactless communication such as NFC contactless methods), radio frequency communication (e.g., RF communication such as short-wavelength radio waves, e.g., UHF waves), and/or any other desired communication technique.

Network component 475, user device 480, remote device 485, sensors 470, communication device 460, sensor 455, user interface 345, and/or any other suitable components of system 300 may include controller components, which may include any suitable computing device of a controller for controlling an operation of system 300 (e.g., components similar to the components described below regarding FIG. 8). The controller components may include for example a processor (e.g., micro-processing logic control device), board components, input/output arrangements that allow it to be connected (e.g., via wireless, Wi-Fi, Bluetooth, or any other suitable communication technique for example as described herein) to other components of system 300.

User device 480 may be any suitable user device for receiving input and/or providing output (e.g., raw data or other desired information) to a user. User device 480 may be, for example, a touchscreen device (e.g., a smartphone, a tablet, a smartboard, and/or any suitable computer device), a computer keyboard and monitor (e.g., desktop or laptop), an audio-based device for entering input and/or receiving output via sound, a tactile-based device for entering input and receiving output based on touch or feel, a dedicated user device or interface designed to work specifically with other components of system 300, and/or any other suitable user device or interface. For example, user device 480 may include a touchscreen device of a smartphone or handheld tablet. For example, user device 480 may include a display that may include a graphical user interface to facilitate entry of input by a user and/or receiving output. For example, system 300 may provide notifications to a user via output transmitted to user device 480 (e.g., or other components of system 300 such as user interface 345). User device 480 may also be any suitable accessory such as a smart watch, Bluetooth headphones, and/or other suitable devices that may communicate with components of system 300.

Remote device 485 may include components that may be generally similar to user interface 345 and/or user device 480. Remote device 485 may for example be a computing device disposed at a remote location such as, for example, an engineering design office. For example, engineering design personnel and/or management personnel may receive and transmit data to other components and users of system 300 in real-time or near real-time (e.g., and/or also with all other suitable components and users of system 300) via network component 475 and/or any other suitable communication technique such as for example as described herein. Users such as engineering design personnel may thereby receive and provide data to system 300 in real-time (e.g., or near real-time). For example, data may be received, transmitted, and/or shared by users of system 300 instantaneously or with a slight delay of a few seconds, a fraction of a minute, and/or any other suitable (e.g., small) delay or lag.

System 300 may include the exemplary disclosed controller having one or more control modules that may be partially or substantially entirely integrated with one or more components of system 300 such as, for example, network component 475, user device 480, remote device 485, sensors 470, communication device 460, sensor 455, user interface 345, and/or any other suitable components of system 300. In at least some exemplary embodiments, the exemplary disclosed controller may be a controller 346 disposed in an operator's cabin of drilling system 305 as illustrated in FIG. 1. The one or more modules (e.g., of the exemplary disclosed controller) may be software modules as described for example below regarding FIG. 8. For example, the one or more modules may include computer-executable code stored in non-volatile memory. The one or more modules may also operate using a processor. The one or more modules may store data and/or be used to control some or all of the exemplary disclosed processes described herein.

In at least some exemplary embodiments, substantially all data of system 300 may be communicated by communication device 460 (e.g., and sensor 455) to controller 346, which may be disposed in operator cabin 340. In at least some exemplary embodiments, substantially all data transfer to and from user device 480 and remote device 485 may be communicated to and from controller 346.

Components of system 300 may be formed from any suitable materials such as, for example, structural metal (e.g., structural steel), co-polymer material, textile material, thermoplastic and thermosetting polymers, resin-containing material, polyethylene, polystyrene, polypropylene, epoxy resins, phenolic resins, Acrylanitrile Butadiene Styrene (ABS), Mix of ABS and PC, Acetal (POM), Acetate, Acrylic (PMMA), Liquid Crystal Polymer (LCP), Mylar, Polyamid-Nylon, Polyamid-Nylon 6, Polyamid-Nylon 11, Polybutylene Terephthalate (PBT), Polycarbonate (PC), Polyetherimide (PEI), Polyethylene (PE), Low Density PE (LDPE), High Density PE (HDPE), Ultra High Molecular Weight PE (UHMW PE), Polyethylene Terephthalate (PET), PolPolypropylene (PP), Polyphthalamide (PPA), Polyphenylenesulfide (PPS), Polystyrene (PS), High Impact Polystyrene (HIPS), Polysulfone (PSU), Polyurethane (PU), Polyvinyl Chloride (PVC), Chlorinated Polyvinyl chloride (CPVC), Polyvinylidenefluoride (PVDF), Styrene Acrylonitrile (SAN), Teflon TFE, Thermoplastic Elastomer (TPE), Thermoplastic Polyurethane (TPU), and/or Engineered Thermoplastic Polyurethane (ETPU), or any suitable combination thereof.

The exemplary disclosed system, apparatus, and method may be used in any suitable application involving providing foundations or other geotechnical engineering components. For example, the exemplary disclosed system, apparatus, and method may be used in any suitable application for providing deep foundations such as pile foundations. In at least some exemplary embodiments, the exemplary disclosed system, apparatus, and method may be used in any suitable application for providing piles such as drilled displacement piles.

Figure 5:
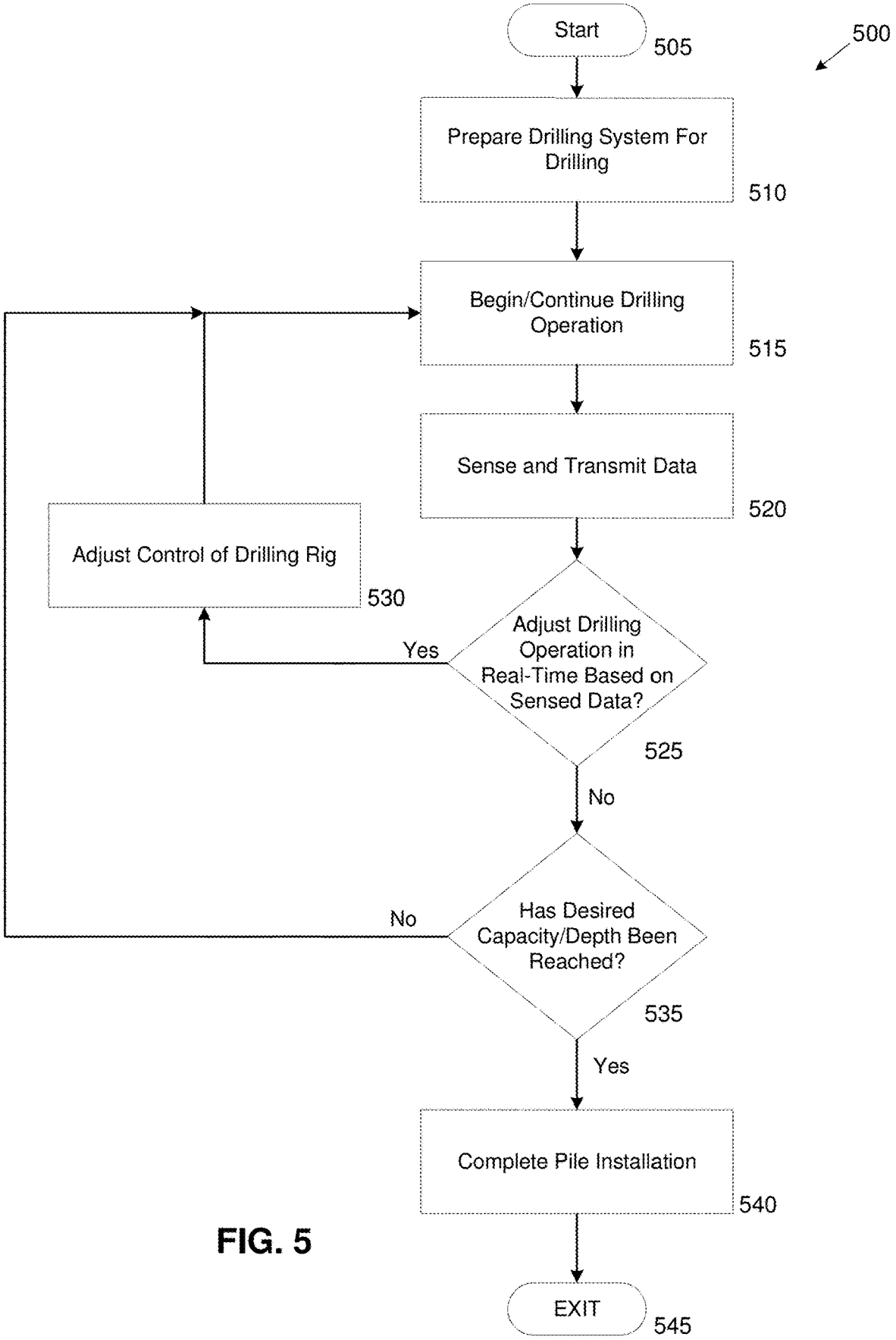
FIG. 5 illustrates an exemplary process of at least some exemplary embodiments of the present disclosure.
Figure 6A:
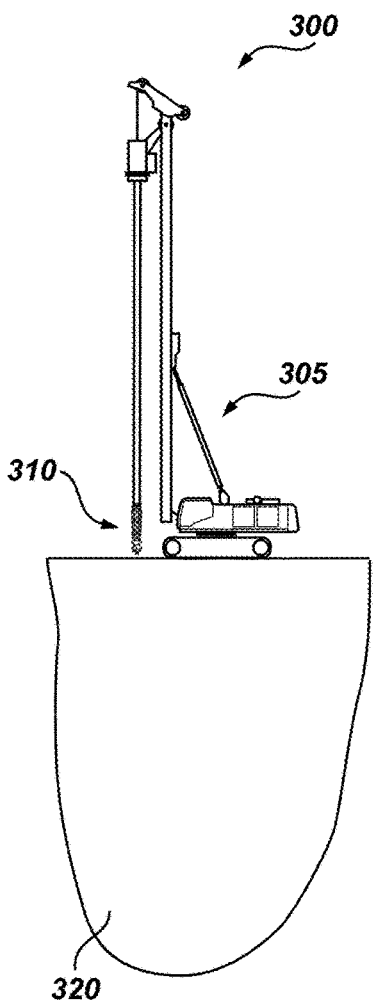
FIGS. 6A, 6B and 6C illustrate an exemplary process of at least some exemplary embodiments of the present disclosure.

FIG. 5 illustrates an exemplary operation of the exemplary disclosed system 300. Process 500 begins at step 505. At step 510, system 300 (e.g., drilling system 305 and drilling assembly 310) may be prepared for a drilling operation. For example and as illustrated in FIG. 6A, drilling system 305 may be positioned at a desired location for drilling and drilling assembly 310 may be attached to drill rod assembly 355 for example as described herein.

Figure 6B:
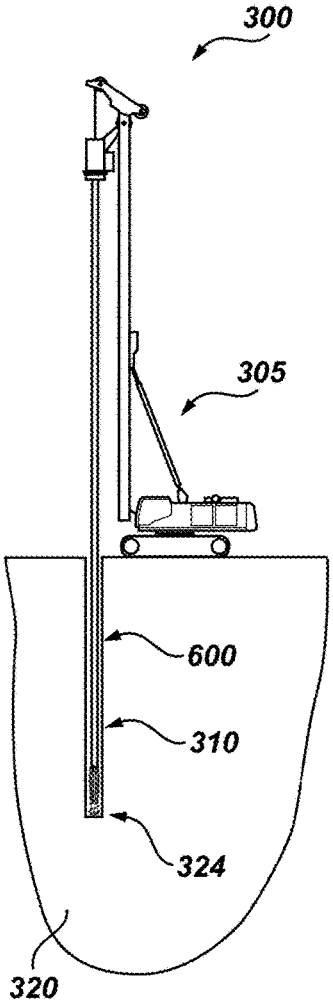

Returning to FIG. 5, process 500 may proceed to step 515 and drilling system 300 may begin drilling operations. As illustrated in FIG. 6B, drilling system 305 may operate to rotate drilling assembly 310 and to push drilling assembly 310 downward into soil layer 320 (e.g., through soil or other material of soil layer 320). Drilling system 305 and drilling assembly 310 may thereby drill a cavity 600 in soil layer 320. Cavity 600 may be for example a bore, hole, or shaft for installing a deep foundation member such as a pile. Cavity 600 may be a substantially vertical cavity. Cavity 600 may also be an angled cavity (e.g., inclined at any desired angle from a vertical direction that may be perpendicular to soil layer 320).

Figure 7:
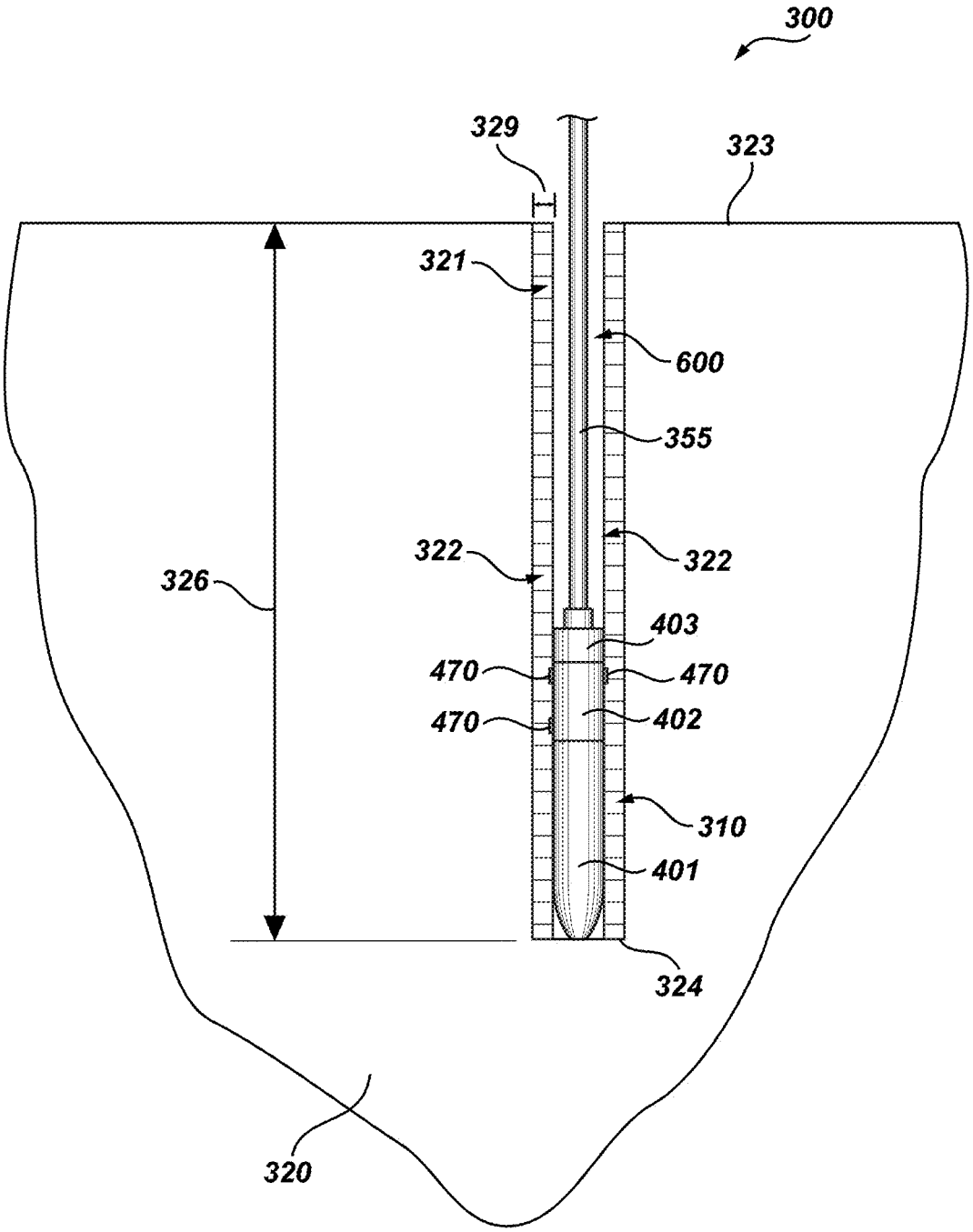
FIG. 7 illustrates a schematic view of at least some exemplary embodiments of the present disclosure.

At step 520, system 300 may operate to sense data of soil layer 320 during the drilling operation of step 515. For example, system 300 may sense, transmit, and make calculations using sensed data of soil layer 320 in real-time or near real-time as the drilling operation of step 515 proceeds. At step 520 and for example as schematically illustrated in FIG. 7, sensors 470 operate to sense data associated with an interface portion 321 of soil layer 320. For example, interface portion 321 may be a pile-soil interface of a pile being installed by system 300 during process 500. For example, as drilling assembly 310 drills down into soil layer 320 to make cavity 600, sensors 470 may sense data of interface portion 321 associated with and/or indicative of an actual lateral stress locked into interface portion 321 based on an operation of drilling assembly 310. For example, sensors 470 may collect data at as many locations of interface portion 321 as desired. For example as illustrated in FIG. 7, sensors 470 may collect data associated with a plurality of interface locations 322 along a length of cavity 600. Interface locations 322 may represent for example discrete points, area, or intervals along a length of cavity 600 where data is sensed and/or a length or area along which data is continuously collected.

In at least some exemplary embodiments as drilling assembly 310 drills down into soil layer 320, body members 401, 402, and 403 may rotate (e.g., rotate clockwise or in any other desired manner). Soil of soil layer 320 is displaced outward (e.g., pushed or compacted into interface portion 321 during advancement of body member 401 through soil layer 320), and a second portion of the soil moves up toward body member 402. This second portion of the soil is pushed out again by an upper portion of body member 401 and by body member 402. Body member 402 provides support to soil of soil layer 320 that has been displaced based on drilling of drilling assembly 310. Sensors 470 disposed for example at body member 402 (e.g., or other portions of drilling assembly 310 or drilling system 305) sense data associated with and/or indicative of an actual lateral stress locked into interface portion 321 based on the operation of drilling assembly 310.

Data sensed by sensors 470 is transmitted at step 520 by wire via connector 465 to communication device 460 (e.g., which transfers the data to user interface 345 and/or any other desired component of system 300) and/or directly wirelessly from sensors 470 to any other desired component of system 300 for example as described above. For example as described above, data collected by sensors 470 is transferred in real-time or near real-time to any desired components of system 300 (e.g., to user interface 345, network component 475, user device 480, remote device 485, and/or any other desired component of system 300). Data collected by sensor 455 such as depth data is similarly transferred in real-time or near real-time.

The data sensed by one or more sensors 470 may be transferred and used in calculations made in real-time or near real-time by the exemplary disclosed controller including the control module (e.g., by the exemplary disclosed processing components of network component 475, user device 480, remote device 485, user interface 345, and/or any other suitable components of system 300). As the drilling operations of step 515 proceed (e.g., as drilling assembly 310 drills down into soil layer 320), the exemplary disclosed calculations are made so that the operation of system 300 may be controlled and/or adjusted as appropriate based on the real-time or near real-time determinations made during the exemplary disclosed calculation for example as described below. Some embodiments of the exemplary disclosed calculations are provided below.

Data associated with or indicative of radial stresses that develop at the pile-soil interface during drilling at step 515 and collected and transmitted by sensors 470 at step 520 may be used to determine a total or an ultimate frictional capacity of a pile installed during process 500. For example, an ultimate frictional capacity of a pile installed during process 500 may be represented by Equation (1) below:

$$P_{s,u} = C\sum_{i=1}^{i=n}(\alpha_i P_{a,i} + c_i)h_i \tag{1}$$

In Equation (1), $P_{a,i}$ is the lateral stress locked into the pile-soil interface at the center of soil layer i and is the parameter that is measured by sensors 470 mounted on drilling assembly 310; $\alpha_i$ is the coefficient of limiting friction between the pile and the soil for layer i; $c_i$ is the cohesion of layer i, and $h_i$ is height of layer i; with C being the circumference of the pile. The respective summations are evaluated for some or substantially all interface locations 322 from a top surface 323 of soil layer 320 (e.g., top surface of the ground) to a pile tip level 324 as illustrated in FIG. 7. Pile tip level 324 may change as drilling assembly 310 drills down and may be determined based on data sensed and transmitted by sensor 455 for example as described herein. As exemplary disclosed process 500 may be an iterative process as illustrated in FIG. 5, the calculations may take place in real-time or near real-time as process 500 iteratively moves between the exemplary disclosed steps (e.g., including steps 520 and 515). For example, any suitable steps of process 500 (e.g., steps 515, 520, 525, 530, and 535) may occur simultaneously or near-simultaneously.

The coefficient of limiting friction $\alpha_i$ and cohesion $c_i$ are functions of the soil friction angle and soil cohesion, respectively, at layer i and may be evaluated through soil investigation that is undertaken at the site where process 500 is performed for example prior to installation of a pile in process 500.

Sensors 470 may collect data associated with or indicative of the lateral stress locked into the pile-soil interface (e.g., interface portion 321) over a pile length 326 (e.g., pile depth). Pile tip level 324 and/or pile length 326 may be determined based on data sensed and transmitted by sensor 455 for example as described herein. The collected data may for example be used to provide the values of $P_{a,i}$ described above. The frictional capacity of a foundation component installed in process 500 (e.g., each pile such as a drilled displacement pile) may be accurately determined during process 500. As exemplary disclosed process 500 may be an iterative process as illustrated in FIG. 5, and the calculations may take place in real-time or near real-time as process 500 iteratively moves between the exemplary disclosed steps (e.g., including steps 520 and 515). Determining the frictional capacity as described herein may result in significant savings in time and cost, as a suitable length of pile (e.g., pile length 326) may be installed for providing (e.g., corresponding to) a desired pile capacity. Also, users of system 300 may have a high confidence that each pile installed in process 500 has a desired (e.g., appropriate or stipulated) factor of safety against applied loads. In at least some exemplary embodiments, $P_{a,i}$ may be determined in real-time over a pile depth (e.g., pile length 326) based on an operation of system 300 (e.g., based on data collected by sensors 470). The frictional capacity of the pile being installed may be provided to operator 350 (e.g., a piling rig operator) via user interface 345 and/or to design personnel (e.g., design engineers for example of a design office) via remote device 485 in real-time or near real-time as process 500 is being performed (e.g., as installation of a pile such as a DDP is taking place in real-time). Operator 350 and/or design personnel and engineering managers may thereby adjust and/or control system 300 during process 500 based on calculations made during step 520.

Returning to FIG. 5, at step 525, system 300 and/or users of system 300 determine whether to adjust or control an operation of system 300 based on the frictional capacity (e.g., and other calculations) calculated at step 520. For example, users of system 300 such as design personnel, a rig operator, construction personnel, and/or managing personnel may make decisions regarding an installation of a deep foundation in real-time or near real-time based on data and output (e.g., frictional capacity of a pile) provided to users by system 300 for example as cavity 600 is being drilled and a pile is being installed. If system 300 is to be adjusted or controlled, system 300 proceeds to step 530.

At step 530, operator 350 may directly control or adjust, and/or other users (e.g., engineering design personnel, construction and/or engineering management personnel, and/or any other suitable users) may direct operator 350 to control or adjust or may directly adjust (e.g., via communication techniques for example as described herein), an operation of drilling system 305 based on calculations, output, and/or determinations provided by system 300 at step 520. For example, operator 350 may receive data, information, and/or output from system 300 via user interface 345 and/or via any other exemplary disclosed communication techniques in real-time or near real-time for example as described herein. Accordingly, operator 350 may for example change, adjust, or control a torque or pull down imparted by drilling system 305 to drilling assembly 310. Alternatively and/or additionally, for example, any user of system 300 may directly control (e.g., directly remotely control) an operation of user interface 345 using any suitable communication technique for example as described herein.

An amount of push-out force that may be applied to the soil by drilling assembly 310 may be variable, and therefore a user (e.g., operator 350 or any other suitable user) may have a significant degree of control over process 500 at step 530. For example, by decreasing the applied torque while maintaining a high pull down on the drilling assembly 310, operator 350 (e.g., and/or any other suitable user) may control drilling system 305 to apply a high outward force on given interface locations 322 of interface portion 321. Also for example, if operator 350 (e.g., and/or any other suitable user) applies more torque in drilling system 305 while maintaining a relatively lower pull down on drilling assembly 310, the lateral expansive stress on the soil (e.g., on interface locations 322 of interface portion 321) becomes less. For example for installations of process 500 involving piles of substantially same pile diameter and substantially same soil conditions of soil layer 320, different drilling control and/or techniques performed at step 530 may lead to significantly different values of stresses that are locked into the surrounding soil (e.g., of interface locations 322 of interface portion 321), which may in turn lead to different ultimate frictional capacities of the pile shaft (e.g., as determined at step 520). Similarly at step 530, attributes of drilling system 305 (e.g., a size of a piling rig used to install any given pile) may also impact pile capacity. For example, drilling system 305 having a relatively higher pull down may rely less on torque to achieve penetration into the soil of soil layer 320. Accordingly, for the substantially same pile diameter and soil, a given drilling system 305 may produce piles of a higher capacity compared to another drilling system 305 having a smaller pull down, which relies more on drilling (e.g., torque) to achieve penetration to any given depth of soil layer 320. Therefore, because a force over the depth of a pile that is locked into the surrounding soil (e.g., of interface locations 322 of interface portion 321) at the time of installation of any given pile (e.g., DDP pile) may be determined using process 500, a frictional capacity of a pile can be evaluated with confidence. Further as described above, a user (e.g., operator 350 or any other suitable user) may control system 300 to achieve a desired pile depth and/or capacity in real-time or near real-time using the exemplary disclosed iterative method of process 500 (e.g., by using output provided by system 300 at step 520 to control or adjust system 300 at step 530 in real-time or near real-time).

System 300 may return to step 515 to continue a drilling operation based on the control adjustments made at step 530. System 300 may iteratively move between steps 515, 520, 525, and 530 as desired by users of system 300. If no adjustments to control are to be made at step 525, system 300 may proceed to step 535 as illustrated in FIG. 5.

At step 535, a user (e.g., operator 350 or any other suitable user such as design, management, and/or other personnel) may determine whether a desired capacity or depth has been reached using calculations at step 520 based on collected data provided by sensors 470 and/or sensor 455. A frictional capacity of the pile to be installed in process 500 may be calculated by summing the frictional capacities (e.g., of interface locations 322) over pile length 326 (e.g., the depth of the pile to be installed). Accordingly in at least some exemplary embodiments at step 535, a total pile capacity for the pile to be installed may be available by the time drilling assembly 310 reaches a pile tip level 324 that may correspond to a design depth. Alternatively, if a design capacity of the pile to be installed has been specified (e.g., rather than a pile depth), the drilled depth (e.g., pile tip level 324 and pile length 326) may be modified in real-time or near real-time using process 500. For example if a drilled depth (e.g., pile tip level 324 and pile length 326) is to be modified based on the actual pile capacity determined at step 520, system 300 may return to step 515 as illustrated in FIG. 5. System 300 may iteratively move between steps 515, 520, 525, 530, and 535 until a desired pile capacity and/or depth is reached at step 535 based on calculations and determinations made and transferred in real-time or near real-time at step 520.

If a user or users (e.g., operator 350 or any other suitable user such as design, management, and/or other personnel) determine that a desired pile capacity and/or depth is reached at step 535 based on calculations and determinations made in real-time or near real-time at step 520, system 300 may proceed to step 540 as illustrated in FIG. 5.

Figure 6C:
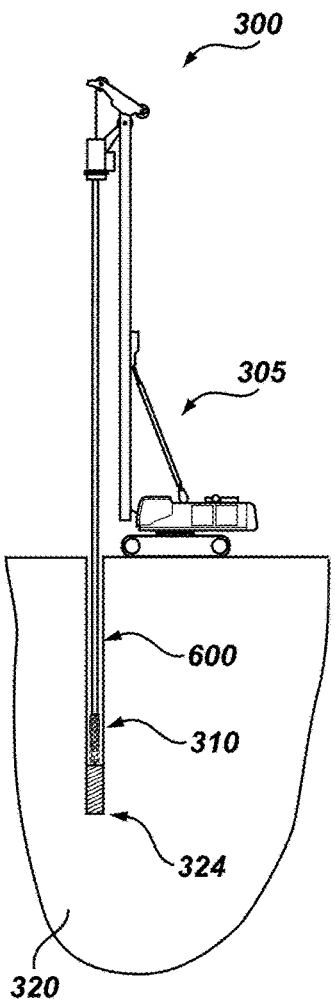

At step 540, further penetration into soil or other material of soil layer 320 is stopped (e.g., terminated). Once drilling assembly 310 reaches the desired depth (e.g., a bottom of end portion 430 reaches a desired pile tip level 324), material 370 such as concrete is pumped or poured from reservoir 365 into drill rod assembly 355 (e.g., cavity 385) and to drilling assembly 310 (e.g., cavity 445) in one continuous operation or by any other suitable technique until cavity 385 of rod assembly 355 and cavity 445 of drilling assembly 310 are substantially full of material 370 (e.g., concrete). Subsequently as illustrated in FIG. 6C, drill rod assembly 355 and drilling assembly 310 are pulled up by drilling system 305, which causes movable member 440 (e.g., a trap door) at the bottom of drilling assembly 310 to open up. Material 370 stored inside cavity 445 of drilling assembly 310 then flows out of cavity 445 and into cavity 600 of soil layer 320. Drill rod assembly 355 and drilling assembly 310 are then extracted at a steady rate as additional material 370 is poured or pumped through cavity 385 of drill rod assembly 355 and cavity 445 of drilling assembly 310. During extraction, body member 403 helps to keep interface portion 321 stable and cavity 600 in place during the placement of material 370. During extraction, cavity 445 of drilling assembly 310 remains substantially full of material 370 at substantially all times so that a suitable pressure head of material 370 is provided. The suitable pressure head allows proper flow of material 370 (e.g., concrete) out through movable member 440 into cavity 600 of soil layer 320. Flow (e.g., pressure) sensors and/or flow meters of drilling system 305 (e.g., mounted at appropriate locations on the drilling rig and for example read in real-time or near real-time by operator 350 or any other suitable user) may be used to confirm (e.g., ensure) that the extraction of drilling assembly 310 is performed at a rate such that a continuous shaft of material 370 (e.g., concrete shaft) is obtained during the operation (e.g., concreting operation) at step 540. Optionally for example, a reinforcement assembly (e.g., a reinforcement cage such as a rebar cage) and/or any other suitable component or assembly may be placed in cavity 600 filled with material 370. A foundation member such as a pile (e.g., reinforced concrete pile such as a DDP pile) may thereby be installed in cavity 600. Process 500 may end at step 545.

In at least some exemplary embodiments and for example as described herein, a lack of availability of the actual lateral stress that is locked into a pile-soil interface at any given depth of a pile may be solved by mounting special pressure sensors in a DDP tools at certain locations and transmitting sensed data in real-time or near real-time through wires that lead through a drill rod. Alternatively, the data from the pressure sensors in the DDP tool may be transmitted using wireless signals. In at least some exemplary embodiments, a receiver mounted at a top of the drill rod may receive the data and relay it through a wireless transmitter to a receiver in a cabin of the piling rig. In at least some exemplary embodiments, a central processing unit in the operator cabin may then convert this data in real time to pressure applied to the soil by the DDP tool at any given depth. In at least some exemplary embodiments, this data may also be relayed in real-time or near real-time to a design office.

In at least some exemplary embodiments, the exemplary disclosed method may be a method for installing a pile in a cavity of a soil layer, including drilling the cavity in the soil layer using a drilling assembly (e.g., drilling assembly 310), applying pressure with the drilling assembly during drilling to an interface portion of the soil layer that is adjacent to the cavity, sensing pressure data of the interface portion during drilling, and transferring the pressure data to a controller during drilling. The exemplary disclosed method may also include determining pile capacity data of the pile with the controller during drilling based on the pressure data, transferring the pile capacity data during drilling, and controlling the drilling assembly based on the pile capacity data during drilling. Sensing the pressure data of the interface portion during drilling may include sensing the pressure data, which is indicative of an actual lateral stress locked into the interface portion based on applying pressure with the drilling assembly, using one or more pressure sensors mounted on the drilling assembly. Drilling the cavity in the soil layer using the drilling assembly may include rotating a first body member and a second body member of the drilling assembly, the first body member increasing in diameter in a direction moving from a bottom portion of the first body member to a top portion of the first body member that is attached to the second body member. The second body member may include one or more pressure sensors that sense the pressure data of the interface portion during drilling. Applying pressure with the drilling assembly during drilling to the interface portion may include supporting the interface portion using the second body member during drilling, the second body member may have a substantially constant diameter along its length that is substantially equal to or larger than the diameter of the first body member. The second body member may include one or more pressure sensors that sense the pressure data of the interface portion during drilling. Transferring the pressure data to the controller during drilling may include transferring the pressure data from the drilling assembly to a communication device attached to a drill rod assembly supporting the drilling assembly via a wire connector disposed in the drill rod assembly. The drill rod assembly may include a first member, which includes a cavity that transfers concrete to the drilling assembly that is disposed in a second member so that a drill rod cavity is formed between an outer surface of the first member and an interior surface of the second member. The wire connector may be a cable that is disposed in the drill rod cavity and extends along the drill rod cavity from the drilling assembly to the communication device. Transferring the pressure data to the controller during drilling further may include transferring the pressure data wirelessly in real-time from the communication device to the controller that is either disposed in an operator cab of a drilling rig supporting the drill rod assembly and the drilling assembly or is disposed at an engineering design office located remotely from the drilling rig. Controlling the drilling assembly based on the pile capacity data during drilling may include wirelessly transferring the pile capacity data to a user interface disposed in an operator cab of a drilling rig supporting the drilling assembly, displaying the pile capacity data using the user interface during drilling, and controlling the user interface during drilling based on the pile capacity data. Determining the pile capacity data of the pile with the controller during drilling based on the pressure data may include calculating an ultimate frictional capacity of the pile based on the pressure data sensed along substantially an entire length of the cavity in the soil layer. The exemplary disclosed method may also include stopping drilling of the cavity in the soil layer based on the calculated ultimate frictional capacity and filling the cavity in the soil layer with concrete to form the pile, wherein the pile is a concrete drilled displacement pile.

In at least some exemplary embodiments, the exemplary disclosed apparatus may be an apparatus for installing a pile in a cavity of a soil layer, including a drilling assembly (e.g., drilling assembly 310) configured to be supported and driven by a drilling rig, at least one pressure sensor (e.g., sensor 470) disposed on the drilling assembly, the at least one pressure sensor configured to sense pressure data that is indicative of an actual lateral stress of the soil layer adjacent to the cavity, and a communication device (e.g., communication device 460) disposed on the drilling rig. The exemplary disclosed apparatus may also include a wire connector connecting the communication device and the at least one pressure sensor, a user interface used by an operator of the drilling rig and wirelessly connected to the communication device, and a controller that is wirelessly connected to the communication device. The controller may be configured to receive the pressure data during drilling. The controller may be configured to determine pile capacity data of the pile during drilling based on the pressure data. The controller may be configured to transfer the pile capacity data to the user interface. The drilling assembly may include a first body member and a second body member. The first body member may increase in diameter in a direction moving from a bottom portion of the first body member to a top portion of the first body member that is attached to the second body member. The second body member may include one or more pressure sensors that sense the pressure data of the interface portion during drilling. The second body member may have a substantially constant diameter along its length that is substantially equal to or larger than the diameter of the first body member. The second member may be attached between the first body member and a third body member, which may be connected to a drill rod assembly of the drilling rig that supports the drilling assembly. The first body member and the third body member may each include auger flights. A drill rod assembly of the drilling rig may support the drilling assembly. The drill rod assembly may include a first member, which includes a cavity that transfers concrete to the drilling assembly, that is disposed in a second member so that a drill rod cavity is formed between an outer surface of the first member and an interior surface of the second member. The wire connector may be a cable that is disposed in the drill rod cavity and extends along the drill rod cavity from the drilling assembly to the communication device that is disposed at the drill rod assembly. Concrete may be poured into the drill rod cavity that is in fluid communication with an assembly cavity of the drilling assembly.

In at least some exemplary embodiments, the exemplary disclosed method may be a method for installing a pile in a cavity of a soil layer, comprising drilling the cavity in the soil layer using a drilling assembly (e.g., drilling assembly 310), applying pressure with the drilling assembly during drilling to an interface portion of the soil layer that is adjacent to the cavity, sensing pressure data of the interface portion during drilling, and transferring the pressure data in real-time or near real-time to a controller during drilling. The exemplary disclosed method may also include determining pile capacity data of the pile with the controller in real-time or near real-time during drilling based on the pressure data, transferring the pile capacity data to a user interface of a drilling system including the drilling assembly in real-time or near real-time during drilling, and changing an operation of the drilling assembly using the user interface based on the pile capacity data during drilling. The exemplary disclosed method may further include continuously updating a total frictional capacity of the pile based on the pile capacity data in real-time or near real-time as the drilling assembly drills down into the soil layer, and repeatedly changing the operation of the drilling assembly using the user interface based on the total frictional capacity during drilling. Determining the pile capacity data of the pile with the controller in real-time or near real-time during drilling based on the pressure data may include calculating and continuously updating the total frictional capacity of the pile based on the pressure data sensed along substantially an entire length of the cavity in the soil layer in real-time or near real-time. The exemplary disclosed method may additionally include stopping drilling of the cavity in the soil layer using the user interface when the total frictional capacity is substantially equal to a desired frictional capacity, and filling the cavity in the soil layer with concrete to form the pile. The exemplary disclosed method may also include stopping drilling of the cavity in the soil layer using the user interface when the entire length of the cavity is substantially equal to a desired entire length, and transferring data of the total frictional capacity calculated in real-time or near real-time when the drilling is stopped to a remote device disposed remotely from the drilling system.

The exemplary disclosed system, apparatus, and method may provide an efficient and effective technique for accurately and reliably determining a load-carrying capacity of piles such as drilled displacement piles. For example, the exemplary disclosed system, apparatus, and method may provide piles having an adequate factor of safety against applied loads. Also, the exemplary disclosed system, apparatus, and method may prevent unnecessary costs by avoiding the installation of piles having significantly more load-carrying capacity than appropriate.

Figure 8:
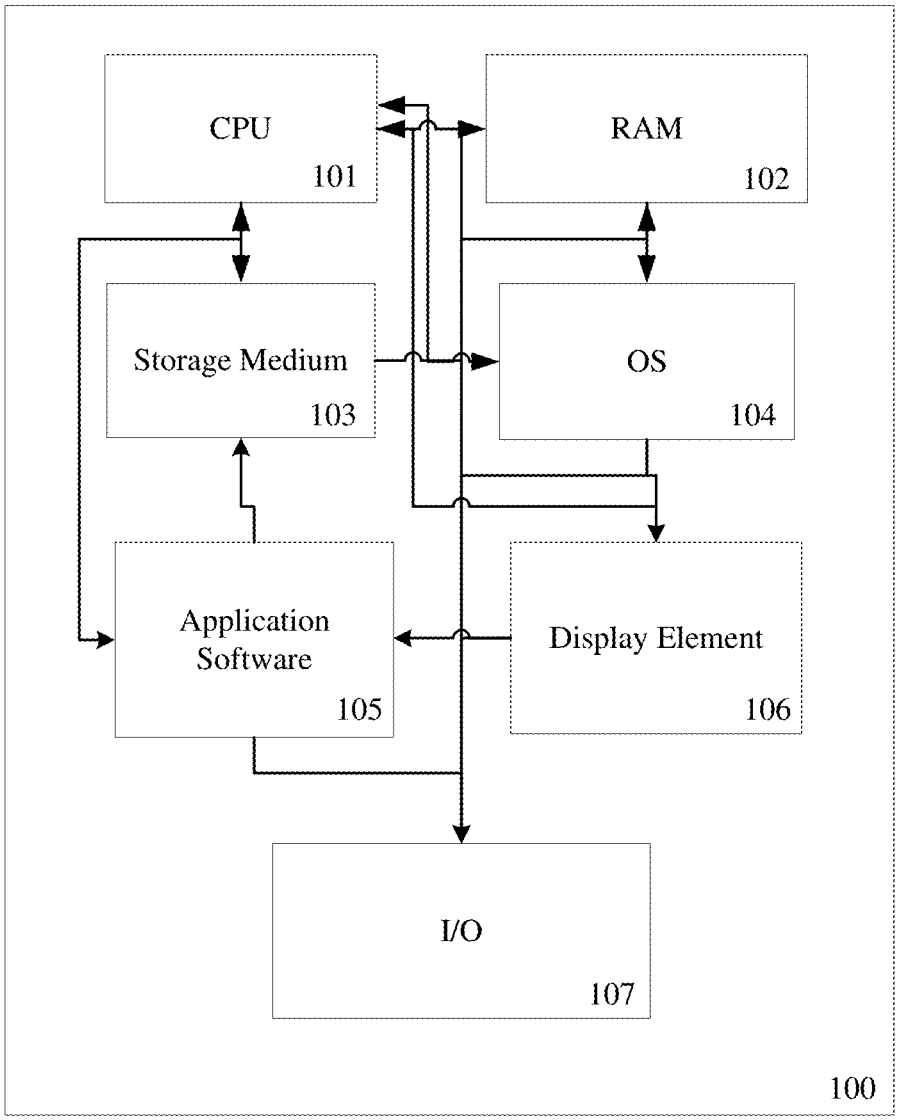
FIG. 8 is a schematic illustration of an exemplary computing device, in accordance with at least some exemplary embodiments of the present disclosure.

An illustrative representation of a computing device appropriate for use with embodiments of the system of the present disclosure is shown in FIG. 8. The computing device 100 can generally be comprised of a Central Processing Unit (CPU, 101), optional further processing units including a graphics processing unit (GPU), a Random Access Memory (RAM, 102), a mother board 103, or alternatively/additionally a storage medium (e.g., hard disk drive, solid state drive, flash memory, cloud storage), an operating system (OS, 104), one or more application software 105, a display element 106, and one or more input/output devices/means 107, including one or more communication interfaces (e.g., RS232, Ethernet, Wi-Fi, Bluetooth, USB). Useful examples include, but are not limited to, personal computers, smart phones, laptops, mobile computing devices, tablet PCs, touch boards, and servers. Multiple computing devices can be operably linked to form a computer network in a manner as to distribute and share one or more resources, such as clustered computing devices and server banks/farms.

Various examples of such general-purpose multi-unit computer networks suitable for embodiments of the disclosure, their typical configuration and many standardized communication links are well known to one skilled in the art, as explained in more detail and illustrated by FIG. 9, which is discussed herein-below.

According to an exemplary embodiment of the present disclosure, data may be transferred to the system, stored by the system and/or transferred by the system to users of the system across local area networks (LANs) (e.g., office networks, home networks) or wide area networks (WANs) (e.g., the Internet). In accordance with the previous embodiment, the system may be comprised of numerous servers communicatively connected across one or more LANs and/or WANs. One of ordinary skill in the art would appreciate that there are numerous manners in which the system could be configured and embodiments of the present disclosure are contemplated for use with any configuration.

In general, the system and methods provided herein may be employed by a user of a computing device whether connected to a network or not. Similarly, some steps of the methods provided herein may be performed by components and modules of the system whether connected or not. While such components/modules are offline, and the data they generated will then be transmitted to the relevant other parts of the system once the offline component/module comes again online with the rest of the network (or a relevant part thereof). According to an embodiment of the present disclosure, some of the applications of the present disclosure may not be accessible when not connected to a network, however a user or a module/component of the system itself may be able to compose data offline from the remainder of the system that will be consumed by the system or its other components when the user/offline system component or module is later connected to the system network.

Figure 9:
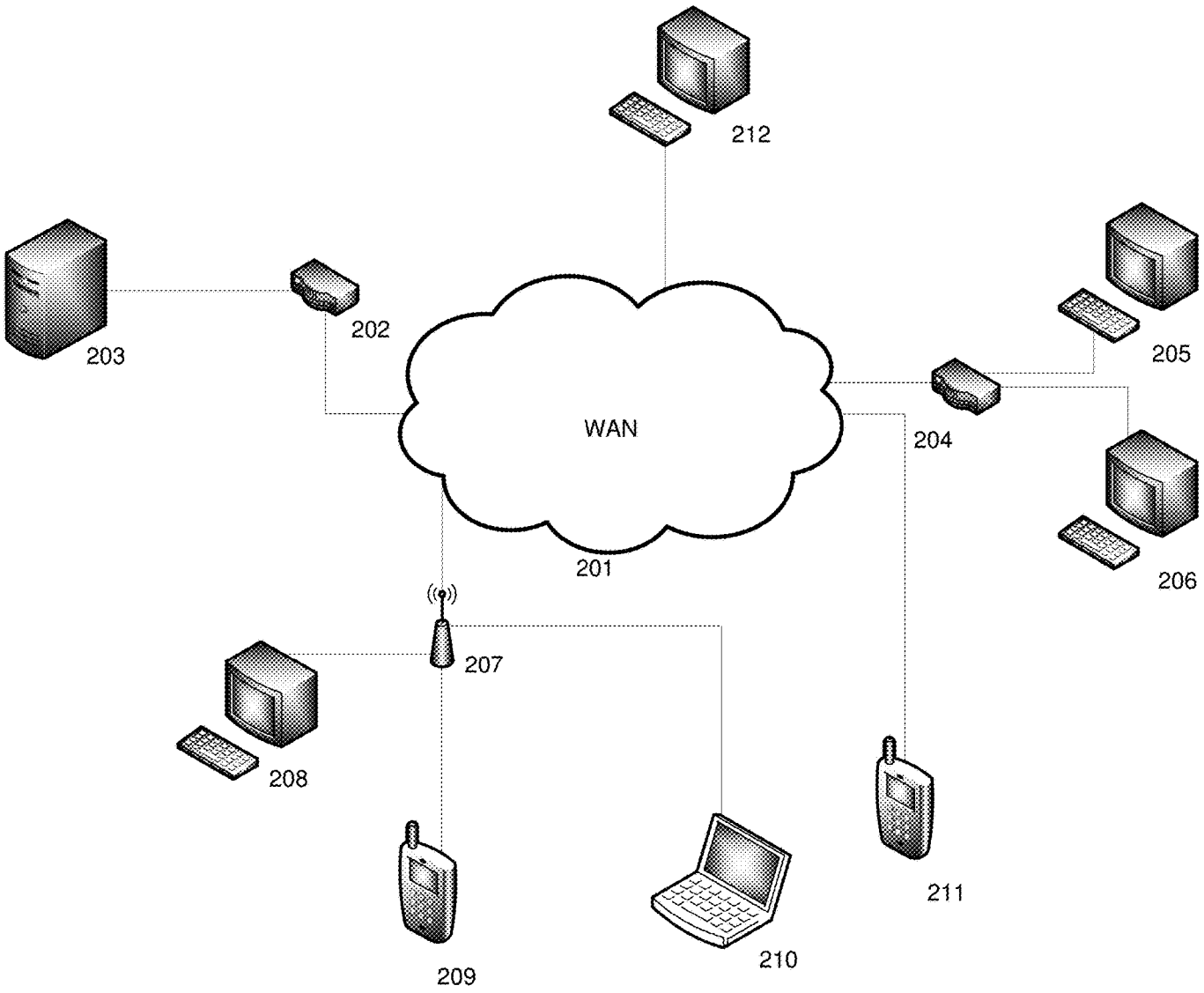
FIG. 9 is a schematic illustration of an exemplary network, in accordance with at least some exemplary embodiments of the present disclosure.

Referring to FIG. 9, a schematic overview of a system in accordance with an embodiment of the present disclosure is shown. The system is comprised of one or more application servers 203 for electronically storing information used by the system. Applications in the server 203 may retrieve and manipulate information in storage devices and exchange information through a WAN 201 (e.g., the Internet). Applications in server 203 may also be used to manipulate information stored remotely and process and analyze data stored remotely across a WAN 201 (e.g., the Internet).

According to an exemplary embodiment, as shown in FIG. 9, exchange of information through the WAN 201 or other network may occur through one or more high speed connections. In some cases, high speed connections may be over-the-air (OTA), passed through networked systems, directly connected to one or more WANs 201 or directed through one or more routers 202. Router(s) 202 are completely optional and other embodiments in accordance with the present disclosure may or may not utilize one or more routers 202. One of ordinary skill in the art would appreciate that there are numerous ways server 203 may connect to WAN 201 for the exchange of information, and embodiments of the present disclosure are contemplated for use with any method for connecting to networks for the purpose of exchanging information. Further, while this application refers to high speed connections, embodiments of the present disclosure may be utilized with connections of any speed.

Components or modules of the system may connect to server 203 via WAN 201 or other network in numerous ways. For instance, a component or module may connect to the system i) through a computing device 212 directly connected to the WAN 201, ii) through a computing device 205, 206 connected to the WAN 201 through a routing device 204, iii) through a computing device 208, 209, 210 connected to a wireless access point 207 or iv) through a computing device 211 via a wireless connection (e.g., CDMA, GSM, 3G, 4G) to the WAN 201. One of ordinary skill in the art will appreciate that there are numerous ways that a component or module may connect to server 203 via WAN 201 or other network, and embodiments of the present disclosure are contemplated for use with any method for connecting to server 203 via WAN 201 or other network. Furthermore, server 203 could be comprised of a personal computing device, such as a smartphone, acting as a host for other computing devices to connect to.

The communications means of the system may be any means for communicating data, including text, binary data, image and video, over one or more networks or to one or more peripheral devices attached to the system, or to a system module or component. Appropriate communications means may include, but are not limited to, wireless connections, wired connections, cellular connections, data port connections, Bluetooth® connections, near field communications (NFC) connections, or any combination thereof. One of ordinary skill in the art will appreciate that there are numerous communications means that may be utilized with embodiments of the present disclosure, and embodiments of the present disclosure are contemplated for use with any communications means.

The exemplary disclosed system may for example utilize collected data to prepare and submit datasets and variables to cloud computing clusters and/or other analytical tools (e.g., predictive analytical tools) which may analyze such data using artificial intelligence neural networks. The exemplary disclosed system may for example include cloud computing clusters performing predictive analysis. For example, the exemplary disclosed system may utilize neural network-based artificial intelligence to predictively assess risk. For example, the exemplary neural network may include a plurality of input nodes that may be interconnected and/or networked with a plurality of additional and/or other processing nodes to determine a predicted result (e.g., a location as described for example herein).

For example, exemplary artificial intelligence processes may include filtering and processing datasets, processing to simplify datasets by statistically eliminating irrelevant, invariant or superfluous variables or creating new variables which are an amalgamation of a set of underlying variables, and/or processing for splitting datasets into train, test and validate datasets using at least a stratified sampling technique. For example, the prediction algorithms and approach may include regression models, tree-based approaches, logistic regression, Bayesian methods, deep-learning and neural networks both as a stand-alone and on an ensemble basis, and final prediction may be based on the model/structure which delivers the highest degree of accuracy and stability as judged by implementation against the test and validate datasets. Also for example, exemplary artificial intelligence processes may include processing for training a machine learning model to make predictions based on data collected by the exemplary disclosed sensors.

Traditionally, a computer program includes a finite sequence of computational instructions or program instructions. It will be appreciated that a programmable apparatus or computing device can receive such a computer program and, by processing the computational instructions thereof, produce a technical effect.

A programmable apparatus or computing device includes one or more microprocessors, microcontrollers, embedded microcontrollers, programmable digital signal processors, programmable devices, programmable gate arrays, programmable array logic, memory devices, application specific integrated circuits, or the like, which can be suitably employed or configured to process computer program instructions, execute computer logic, store computer data, and so on. Throughout this disclosure and elsewhere a computing device can include any and all suitable combinations of at least one general purpose computer, special-purpose computer, programmable data processing apparatus, processor, processor architecture, and so on. It will be understood that a computing device can include a computer-readable storage medium and that this medium may be internal or external, removable and replaceable, or fixed. It will also be understood that a computing device can include a Basic Input/Output System (BIOS), firmware, an operating system, a database, or the like that can include, interface with, or support the software and hardware described herein.

Embodiments of the system as described herein are not limited to applications involving conventional computer programs or programmable apparatuses that run them. It is contemplated, for example, that embodiments of the disclosure as claimed herein could include an optical computer, quantum computer, analog computer, or the like.

Regardless of the type of computer program or computing device involved, a computer program can be loaded onto a computing device to produce a particular machine that can perform any and all of the depicted functions. This particular machine (or networked configuration thereof) provides a technique for carrying out any and all of the depicted functions.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. Illustrative examples of the computer readable storage medium may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A data store may be comprised of one or more of a database, file storage system, relational data storage system or any other data system or structure configured to store data. The data store may be a relational database, working in conjunction with a relational database management system (RDBMS) for receiving, processing and storing data. A data store may comprise one or more databases for storing information related to the processing of moving information and estimate information as well one or more databases configured for storage and retrieval of moving information and estimate information.

Computer program instructions can be stored in a computer-readable memory capable of directing a computer or other programmable data processing apparatus to function in a particular manner. The instructions stored in the computer-readable memory constitute an article of manufacture including computer-readable instructions for implementing any and all of the depicted functions.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

The elements depicted in flowchart illustrations and block diagrams throughout the figures imply logical boundaries between the elements. However, according to software or hardware engineering practices, the depicted elements and the functions thereof may be implemented as parts of a monolithic software structure, as standalone software components or modules, or as components or modules that employ external routines, code, services, and so forth, or any combination of these. All such implementations are within the scope of the present disclosure. In view of the foregoing, it will be appreciated that elements of the block diagrams and flowchart illustrations support combinations of means for performing the specified functions, combinations of steps for performing the specified functions, program instruction technique for performing the specified functions, and so on.

It will be appreciated that computer program instructions may include computer executable code. A variety of languages for expressing computer program instructions are possible, including without limitation Kotlin, Swift, C#, PHP, C, C++, Assembler, Java, HTML, JavaScript, CSS, and so on. Such languages may include assembly languages, hardware description languages, database programming languages, functional programming languages, imperative programming languages, and so on. In some embodiments, computer program instructions can be stored, compiled, or interpreted to run on a computing device, a programmable data processing apparatus, a heterogeneous combination of processors or processor architectures, and so on. Without limitation, embodiments of the system as described herein can take the form of mobile applications, firmware for monitoring devices, web-based computer software, and so on, which includes client/server software, software-as-a-service, peer-to-peer software, or the like.

In some embodiments, a computing device enables execution of computer program instructions including multiple programs or threads. The multiple programs or threads may be processed more or less simultaneously to enhance utilization of the processor and to facilitate substantially simultaneous functions. By way of implementation, any and all methods, program codes, program instructions, and the like described herein may be implemented in one or more thread. The thread can spawn other threads, which can themselves have assigned priorities associated with them. In some embodiments, a computing device can process these threads based on priority or any other order based on instructions provided in the program code.

Unless explicitly stated or otherwise clear from the context, the verbs "process" and "execute" are used interchangeably to indicate execute, process, interpret, compile, assemble, link, load, any and all combinations of the foregoing, or the like. Therefore, embodiments that process computer program instructions, computer-executable code, or the like can suitably act upon the instructions or code in any and all of the ways just described.

The functions and operations presented herein are not inherently related to any particular computing device or other apparatus. Various general-purpose systems may also be used with programs in accordance with the teachings herein, or it may prove convenient to construct more specialized apparatus to perform the required method steps. The required structure for a variety of these systems will be apparent to those of ordinary skill in the art, along with equivalent variations. In addition, embodiments of the disclosure are not described with reference to any particular programming language. It is appreciated that a variety of programming languages may be used to implement the present teachings as described herein, and any references to specific languages are provided for disclosure of enablement and best mode of embodiments of the disclosure. Embodiments of the disclosure are well suited to a wide variety of computer network systems over numerous topologies. Within this field, the configuration and management of large networks include storage devices and computing devices that are communicatively coupled to dissimilar computing and storage devices over a network, such as the Internet, also referred to as "web" or "world wide web".

Throughout this disclosure and elsewhere, block diagrams and flowchart illustrations depict methods, apparatuses (e.g., systems), and computer program products. Each element of the block diagrams and flowchart illustrations, as well as each respective combination of elements in the block diagrams and flowchart illustrations, illustrates a function of the methods, apparatuses, and computer program products. Any and all such functions ("depicted functions") can be implemented by computer program instructions; by special-purpose, hardware-based computer systems; by combinations of special purpose hardware and computer instructions; by combinations of general purpose hardware and computer instructions; and so on—any and all of which may be generally referred to herein as a "component", "module," or "system."

While the foregoing drawings and description set forth functional aspects of the disclosed systems, no particular arrangement of software for implementing these functional aspects should be inferred from these descriptions unless explicitly stated or otherwise clear from the context.

Each element in flowchart illustrations may depict a step, or group of steps, of a computer-implemented method. Further, each step may contain one or more sub-steps. For the purpose of illustration, these steps (as well as any and all other steps identified and described above) are presented in order. It will be understood that an embodiment can contain an alternate order of the steps adapted to a particular application of a technique disclosed herein. All such variations and modifications are intended to fall within the scope of this disclosure. The depiction and description of steps in any particular order is not intended to exclude embodiments having the steps in a different order, unless required by a particular application, explicitly stated, or otherwise clear from the context.

The functions, systems and methods herein described could be utilized and presented in a multitude of languages. Individual systems may be presented in one or more languages and the language may be changed with ease at any point in the process or methods described above. One of ordinary skill in the art would appreciate that there are numerous languages the system could be provided in, and embodiments of the present disclosure are contemplated for use with any language.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

It will be apparent to those skilled in the art that various modifications and variations can be made to the disclosed system and method. Other embodiments will be apparent to those skilled in the art from consideration of the specification and practice of the disclosed method and apparatus. It is intended that the specification and examples be considered as exemplary only, with a true scope being indicated by the following claims.

What is claimed is:

1. A method for installing a pile in a cavity of a soil layer, comprising:

drilling the cavity in the soil layer using a drilling assembly;

applying pressure with the drilling assembly during drilling to an interface portion of the soil layer that is adjacent to the cavity;

sensing pressure data of the interface portion during drilling;

transferring the pressure data to a controller during drilling;

determining pile capacity data of the pile with the controller during drilling based on the pressure data;

transferring the pile capacity data during drilling; and controlling the drilling assembly based on the pile capacity data during drilling;

wherein determining the pile capacity data of the pile with the controller during drilling based on the pressure data includes calculating an ultimate frictional capacity of the pile based on the pressure data sensed along substantially an entire length of the cavity in the soil layer.

2. The method of claim 1, wherein sensing the pressure data of the interface portion during drilling includes sensing the pressure data, which is indicative of an actual lateral stress locked into the interface portion based on applying pressure with the drilling assembly, using one or more pressure sensors mounted on the drilling assembly.

3. The method of claim 1, wherein drilling the cavity in the soil layer using the drilling assembly includes rotating a first body member and a second body member of the drilling assembly, the first body member increasing in diameter in a direction moving from a bottom portion of the first body member to a top portion of the first body member that is attached to the second body member.

4. The method of claim 3, wherein the second body member supports the drilling assembly and includes one or more pressure sensors that sense the pressure data of the interface portion during drilling.

5. The method of claim 3, wherein:

applying pressure with the drilling assembly during drilling to the interface portion includes supporting the interface portion using the second body member during drilling;

the second body member has a substantially constant diameter along its length that is substantially equal to or larger than the diameter of the first body member; and the second body member includes one or more pressure sensors that sense the pressure data of the interface portion during drilling.

6. The method of claim 1, wherein transferring the pressure data to the controller during drilling includes transferring the pressure data from the drilling assembly to a communication device attached to a drill rod assembly supporting the drilling assembly via a wire connector disposed in the drill rod assembly.

7. The method of claim 6, wherein:

the drill rod assembly includes a first member, which includes a cavity that transfers concrete to the drilling assembly, that is disposed in a second member so that a drill rod cavity is formed between an outer surface of the first member and an interior surface of the second member; and the wire connector is a cable that is disposed in the drill rod cavity and extends along the drill rod cavity from the drilling assembly to the communication device.

8. The method of claim 6, wherein transferring the pressure data to the controller during drilling further includes transferring the pressure data wirelessly in real-time from the communication device to the controller that is either disposed in an operator cab of a drilling rig supporting the drill rod assembly and the drilling assembly or is disposed at an engineering design office located remotely from the drilling rig.

9. The method of claim 1, wherein controlling the drilling assembly based on the pile capacity data during drilling includes:

wirelessly transferring the pile capacity data to a user interface disposed in an operator cab of a drilling rig supporting the drilling assembly;

displaying the pile capacity data using the user interface during drilling; and controlling the user interface during drilling based on the pile capacity data.

10. The method of claim 1, further comprising stopping drilling of the cavity in the soil layer based on the calculated ultimate frictional capacity and filling the cavity in the soil layer with concrete to form the pile;

wherein the pile is a concrete drilled displacement pile.

11. An apparatus for installing a pile in a cavity of a soil layer, comprising:

a drilling assembly configured to be supported and driven by a drilling rig;

at least one pressure sensor disposed on the drilling assembly, the at least one pressure sensor configured to sense pressure data that is indicative of an actual lateral stress of the soil layer adjacent to the cavity;

a communication device disposed on the drilling rig;

a wire connector connecting the communication device and the at least one pressure sensor;

a user interface configured to be used by an operator of the drilling rig and wirelessly connected to the communication device; and a controller that is wirelessly connected to the communication device;

wherein the controller is configured to receive the pressure data during drilling;

wherein the controller is configured to determine pile capacity data of the pile during drilling based on the pressure data;

wherein the controller is configured to transfer the pile capacity data to the user interface;

wherein a drill rod assembly of the drilling rig supports the drilling assembly;

wherein the drill rod assembly includes a first member, including a cavity that transfers concrete to the drilling assembly, which is disposed in a second member so that a drill rod cavity is formed between an outer surface of the first member and an interior surface of the second member;

wherein the wire connector is a cable that is disposed in the drill rod cavity and extends along the drill rod cavity from the drilling assembly to the communication device that is disposed at the drill rod assembly; and wherein concrete is poured into the drill rod cavity that is in fluid communication with an assembly cavity of the drilling assembly.

12. The apparatus of claim 11, wherein:

the drilling assembly includes a first body member and a second body member;

the first body member increases in diameter in a direction moving from a bottom portion of the first body member to a top portion of the first body member that is attached to the second body member; and the second body member includes the at least one pressure sensor.

13. The apparatus of claim 12, wherein:

the second body member has a substantially constant diameter along its length that is substantially equal to or larger than the diameter of the first body member;

the second member is attached between the first body member and a third body member;

the third body member is connected to the drill rod assembly of the drilling rig that supports the drilling assembly; and the first body member and the third body member include auger flights.

14. A method for installing a pile in a cavity of a soil layer, comprising:

drilling the cavity in the soil layer using a drilling assembly;

applying pressure with the drilling assembly during drilling to an interface portion of the soil layer that is adjacent to the cavity;

sensing pressure data of the interface portion during drilling;

transferring the pressure data in real-time or near real-time to a controller during drilling;

determining pile capacity data of the pile with the controller in real-time or near real-time during drilling based on the pressure data;

transferring the pile capacity data to a user interface of a drilling system including the drilling assembly in real-time or near real-time during drilling; and changing an operation of the drilling assembly using the user interface based on the pile capacity data during drilling;

continuously updating a total frictional capacity of the pile based on the pile capacity data in real-time or near real-time as the drilling assembly drills down into the soil layer; and repeatedly changing the operation of the drilling assembly using the user interface based on the continuously-updated total frictional capacity during drilling.

15. The method of claim 14, wherein determining the pile capacity data of the pile with the controller in real-time or near real-time during drilling based on the pressure data includes calculating and continuously updating the total frictional capacity of the pile based on the pressure data sensed along substantially an entire length of the cavity in the soil layer in real-time or near real-time.

16. The method of claim 15, further comprising:

stopping drilling of the cavity in the soil layer using the user interface when the total frictional capacity is substantially equal to a desired frictional capacity; and filling the cavity in the soil layer with concrete to form the pile.

17. The method of claim 15, further comprising:

stopping drilling of the cavity in the soil layer using the user interface when the entire length of the cavity is substantially equal to a desired length; and transferring data of the total frictional capacity calculated in real-time or near real-time when the drilling is stopped to a remote device disposed remotely from the drilling system.

* * * * *